US008888100B2

(12) United States Patent
Kamph et al.

(10) Patent No.: US 8,888,100 B2
(45) Date of Patent: Nov. 18, 2014

(54) ELECTRONIC TOY

(71) Applicant: Mattel, Inc., El Segundo, CA (US)

(72) Inventors: Carl J Kamph, Bethlehem, PA (US); C. Hit Ho, Rosemead, CA (US); Andrew J. Riggs, El Segundo, CA (US); Erich Weidetz, Santa Monica, CA (US); Paul D. Middleton, San Francisco, CA (US)

(73) Assignee: Mattel, Inc., El Segundo, CA (US)

( * ) Notice: Subject to any disclaimer, the term of this patent is extended or adjusted under 35 U.S.C. 154(b) by 265 days.

(21) Appl. No.: 13/677,084

(22) Filed: Nov. 14, 2012

(65) Prior Publication Data

US 2013/0143655 A1 Jun. 6, 2013

Related U.S. Application Data

(60) Provisional application No. 61/560,552, filed on Nov. 16, 2011.

(51) Int. Cl.

| | |
|---|---|
| ***A63F 3/00*** | (2006.01) |
| ***A63F 9/24*** | (2006.01) |
| ***A63F 9/08*** | (2006.01) |
| *A63F 11/00* | (2006.01) |

(52) U.S. Cl.

CPC . *A63F 9/24* (2013.01); *A63F 9/088* (2013.01); *A63F 2009/2444* (2013.01); *A63F 2009/2451* (2013.01); *A63F 2009/247* (2013.01); *A63F 2011/0083* (2013.01)

USPC ..... 273/237

(58) Field of Classification Search

CPC ..... G06F 15/8023; Y10S 439/00; Y10S 439/928; H01R 23/70; A63F 13/10; A63F 11/00; A63F 9/0612; A63F 9/0613; A63F 9/088; A63F 2009/1061

USPC ..... 463/36

See application file for complete search history.

(56) References Cited

U.S. PATENT DOCUMENTS

| | | | |
|---|---|---|---|
| 3,933,354 | A | 1/1976 | Goldfarb et al. |
| 3,961,794 | A | 6/1976 | Goldfarb et al. |
| 4,088,315 | A | 5/1978 | Schemmel |
| 4,207,087 | A | 6/1980 | Morrison et al. |
| 4,359,220 | A | 11/1982 | Morrison et al. |
| 4,955,602 | A | 9/1990 | Rastelli |
| 4,974,833 | A | 12/1990 | Hartman et al. |

(Continued)

OTHER PUBLICATIONS

Milton Bradley; "Simon Manual"; Copyright 1978 Milton Bradley; 4 pages.

(Continued)

*Primary Examiner* — Reginald Renwick

(74) *Attorney, Agent, or Firm* — Kolisch Hartwell, PC

(57) ABSTRACT

An electronic game device including a first sensor section hingedly connected to a second sensor section. One or more proximity sensors and one or more output devices are operatively connected to the sensor sections by circuitry. The first sensor section and the second sensor section each include a sensor space such that placement of an object in the sensor space of the associated sensor section may actuate the one or more proximity sensors of that sensor section. The circuitry is configured to determine whether the proximity sensors are actuated and to emit an output signal. Hinges allow the game device to be folded from a linear game orientation, to a multi-dimensional game orientation, and to a bi-linear game orientation.

24 Claims, 7 Drawing Sheets

(56) References Cited

U.S. PATENT DOCUMENTS

| | | | | |
|---|---|---|---|---|
| 5,396,265 | A | 3/1995 | Ulrich et al. | |
| 5,618,045 | A | 4/1997 | Kagan et al. | |
| 5,691,885 | A | 11/1997 | Ward et al. | |
| 5,941,714 | A * | 8/1999 | Gorbet et al. | 439/38 |
| 6,086,478 | A | 7/2000 | Klitsner et al. | |
| 6,210,278 | B1 | 4/2001 | Klitsner | |
| 6,227,968 | B1 | 5/2001 | Suzuki et al. | |
| 6,410,835 | B2 | 6/2002 | Suzuki et al. | |
| 6,463,859 | B1 | 10/2002 | Ikezawa et al. | |
| 6,464,503 | B1 | 10/2002 | Heit et al. | |
| 6,652,383 | B1 | 11/2003 | Sonoda et al. | |
| 6,682,392 | B2 | 1/2004 | Chan | |
| 6,795,318 | B2 | 9/2004 | Haas et al. | |
| 7,082,578 | B1 | 7/2006 | Fishkin et al. | |
| 7,095,387 | B2 | 8/2006 | Lee et al. | |
| 7,117,009 | B2 | 10/2006 | Wong et al. | |
| 7,184,718 | B2 | 2/2007 | Newman et al. | |
| 7,289,084 | B2 | 10/2007 | Lesniak | |
| 7,351,148 | B1 | 4/2008 | Rothschild et al. | |
| 7,371,177 | B2 | 5/2008 | Ellis et al. | |
| 7,456,823 | B2 | 11/2008 | Poupyrev et al. | |
| 7,504,577 | B2 | 3/2009 | Riopelle | |
| 7,505,797 | B2 | 3/2009 | Kim | |
| 7,628,699 | B2 | 12/2009 | Onoda et al. | |
| 7,636,071 | B2 | 12/2009 | O'Gorman | |
| 7,692,634 | B2 | 4/2010 | Kimura et al. | |
| 7,699,693 | B2 | 4/2010 | Schwartz | |
| 7,985,137 | B1 | 7/2011 | Klitsner et al. | |
| 8,088,003 | B1 | 1/2012 | Bickerton et al. | |
| 2002/0111202 | A1 | 8/2002 | Annis et al. | |
| 2006/0154711 | A1* | 7/2006 | Ellis et al. | 463/1 |
| 2007/0103382 | A1 | 5/2007 | Chang et al. | |
| 2007/0178980 | A1 | 8/2007 | Hardin et al. | |
| 2008/0165269 | A1 | 7/2008 | Kim et al. | |
| 2008/0218484 | A1 | 9/2008 | Nishiwaki | |
| 2008/0280682 | A1 | 11/2008 | Brunner et al. | |
| 2009/0102120 | A1 | 4/2009 | Hou et al. | |
| 2009/0104988 | A1 | 4/2009 | Enge et al. | |
| 2009/0179874 | A1 | 7/2009 | Watanabe | |
| 2009/0197658 | A1 | 8/2009 | Polchin | |
| 2009/0273560 | A1 | 11/2009 | Kalanithi et al. | |
| 2009/0303208 | A1 | 12/2009 | Case et al. | |
| 2009/0322790 | A1 | 12/2009 | Behar et al. | |
| 2010/0003651 | A1 | 1/2010 | Zilber | |
| 2010/0007613 | A1 | 1/2010 | Costa | |
| 2010/0060664 | A1 | 3/2010 | Kilpatrick, II et al. | |
| 2010/0066685 | A1 | 3/2010 | Cain et al. | |
| 2010/0079355 | A1 | 4/2010 | Kilpatrick, II et al. | |
| 2010/0113148 | A1 | 5/2010 | Haltovsky et al. | |
| 2010/0156913 | A1 | 6/2010 | Ortega et al. | |
| 2010/0177047 | A1 | 7/2010 | Brenneman et al. | |
| 2010/0182265 | A1 | 7/2010 | Kim et al. | |
| 2010/0207888 | A1 | 8/2010 | Camiel | |
| 2010/0248839 | A1 | 9/2010 | Davis et al. | |
| 2010/0261514 | A1 | 10/2010 | Gramelspacher et al. | |
| 2010/0283798 | A1 | 11/2010 | Hallbauer et al. | |
| 2010/0298032 | A1 | 11/2010 | Lee et al. | |
| 2010/0311485 | A1 | 12/2010 | Ritter et al. | |
| 2010/0321275 | A1 | 12/2010 | Hinckley et al. | |
| 2011/0115737 | A1 | 5/2011 | Fuyuno et al. | |
| 2011/0128216 | A1 | 6/2011 | Renwick | |

OTHER PUBLICATIONS

Milton Bradley; Photograph of the Simon Toy; 1978; 1 page.

* cited by examiner

ELECTRONIC TOY

CROSS-REFERENCE TO RELATED APPLICATIONS

This application claims priority to U.S. Provisional Patent Application Ser. No. 61/560,552 entitled ELECTRIC TOY, filed on Nov. 16, 2011, the disclosure of which is incorporated herein by reference.

FIELD OF THE DISCLOSURE

This disclosure relates to electronic toys in the form of electronic game devices, and more particularly to modular electronic game devices with moveable parts and sensors to determine the proximity of a player's hand or finger relative to a sensor space. The disclosed game devices allow a user to play various motor skills games and pattern memory games.

BACKGROUND OF THE DISCLOSURE

Examples of motor skills games and devices can be found in the disclosures of U.S. Pat. Nos. 7,504,577, 6,463,859, 6,410,835, 6,227,968, 4,974,833, 4,955,602, 4,088,315, 3,961,794, and 3,933,354 and U.S. Patent Publication No. U.S. 20020111202. Examples of electronic pattern memory games can be found in the disclosures of U.S. Pat. Nos. 4,359,220, 4,207,087, and the Milton Bradley game SIMON. Examples of electronic devices having a moveable part can be found in the disclosures of U.S. Pat. No. 7,095,387 and U.S. Patent Publication Nos. U.S. 20100060664 and U.S. 20070178980. The disclosures of these and all other publications referenced herein are incorporated by reference in their entirety for all purposes.

SUMMARY OF THE DISCLOSURE

An electronic game device is provided that may include a first sensor section hingedly connected to a second sensor section by a hinge. The electronic game device may also include one or more proximity sensors and one or more output devices operatively connected to the sensor sections. Furthermore, the electronic game device may include circuitry which may be connected to the one or more proximity sensors and the one or more output devices. The first sensor section and the second sensor section may each include a sensor space such that placement of an object in the sensor space of the associated sensor section may actuate the one or more proximity sensors of that sensor section. The circuitry may be configured to determine whether the proximity sensors are actuated and to emit an output signal.

Moreover, the hinge may allow the electronic game device to be used in a linear game orientation with at least two sensor spaces in an approximate line, in a multi-dimensional game orientation with the sensor space of the first sensor section oriented along a line transverse to the orientation of the sensor space of the second sensor section, and in a bi-linear game orientation with the first sensor section and the second sensor section on opposing sides of an approximate plane to form at least one matched sensor space.

Additionally, the electronic game device may include a third sensor section hingedly connected to the second sensor section and a fourth sensor section hingedly connected to the third sensor section, wherein the sensor sections may be hingedly connected by hinges. The third sensor section and the fourth sensor section may each include a sensor space and one or more proximity sensors such that placement of an object in the sensor space of the associated sensor section may actuate the one or more proximity sensors of that sensor section. Also, the hinges between the first sensor section and the second sensor section, between the second sensor section and third sensor section, and between the third sensor section and fourth sensor section may allow the electronic game device to be used in a quadrilateral game orientation in which the sensor space of the first sensor section, the sensor space of the second sensor section, the sensor space of the third sensor section, and the sensor space of the fourth sensor section may be oriented to form an approximate quadrilateral.

Some embodiments include an electronic game device with a central sensor section having two light beam interception zones, and matched outer sensor sections each having a light beam interception zone and each being hinged to the central section, wherein the game may be converted from a linear game with at least four light beam interception zones in an approximate line, to a multi-dimensional game with orthogonally located light beam interception zones, to a bi-linear game with at least two pairs of light beam interception zones on opposing sides of an approximate plane.

Each sensor section may include a shaped frame member, such as a full or partial ring or hoop, each of which may define a sensor space or light beam interception zone. In some embodiments, each frame member includes a proximity sensor adapted to be actuated when an object, such as a player's hand, is within the sensor space of that proximity sensor.

The game device may include one or more output devices, such as speakers and/or illumination devices, configured to emit output signals upon actuation of a proximity sensor or to prompt actuation of a proximity sensor. Circuitry within the game may be configured to record the order in which various proximity sensors are actuated, determine whether proximity sensors are actuated according to a predetermined or recorded pattern, prompt the output devices to emit output signals, measure a duration of time and/or determine a game orientation of the game device.

Methods of game play suitable for use with such embodiments may involve one or more players attempting to emulate the predetermined pattern by actuating the various proximity sensors, such as by each player passing his or her hands through the various frame members in a certain order or direction. The order or direction may be presented by the game device, via the output devices (such as a pattern of lights corresponding to the various frame members), or determined by the players of the game.

Advantages of the present disclosure will be more readily understood after considering the drawings and the Detailed Description.

Figure 1:
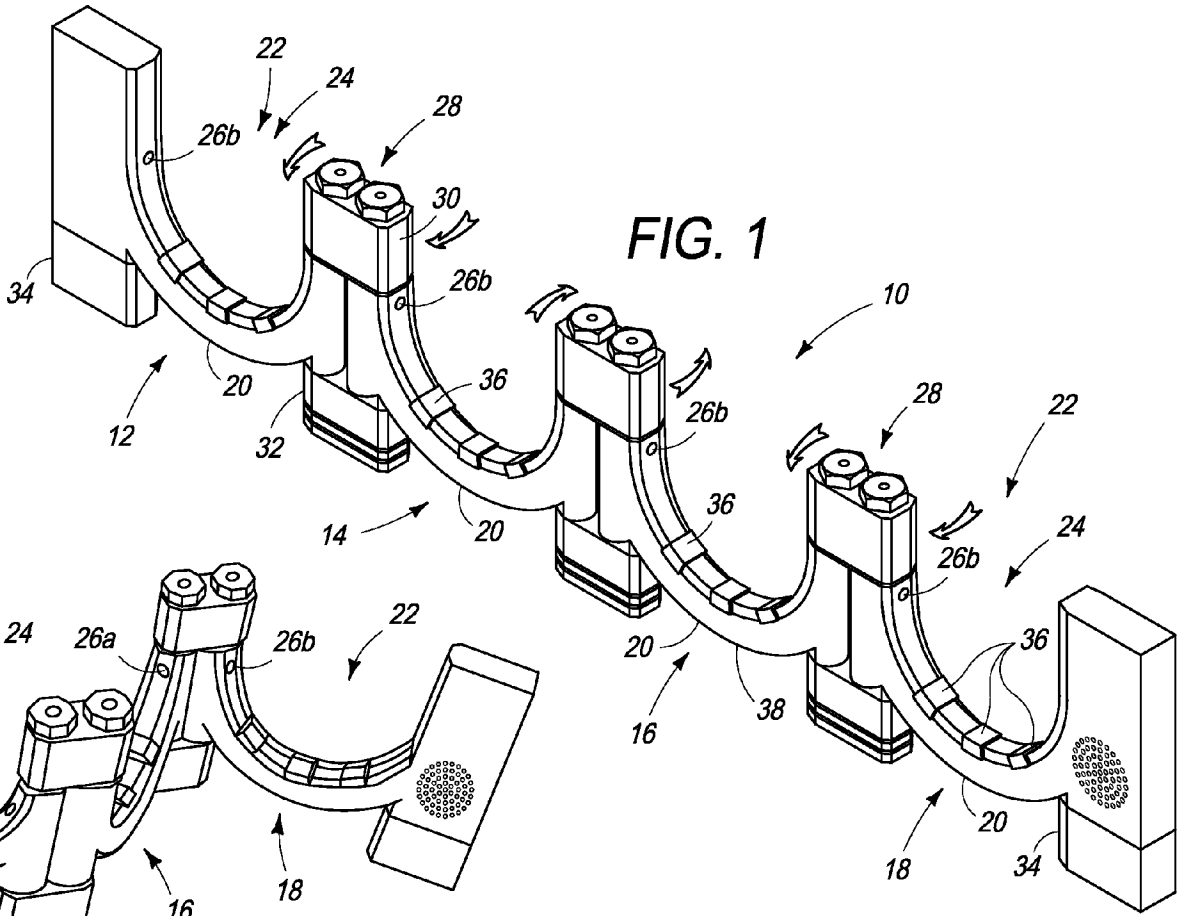
FIG. 1 is an upper perspective view of an embodiment of a game device including a plurality of sensor sections in a linear game orientation.

The drawings illustrate embodiments and schematic concepts for electronic game devices according to the present disclosure. The purpose of these drawing is to aid in explaining the principles of the present disclosure. Thus, the drawings should not be considered as limiting the scope of the present disclosure to the embodiments and schematic concepts shown therein. Other embodiments of electronic game devices may be created which follow the principles of the present disclosure as taught herein, and these other embodiments are intended to be included within the scope of patent protection.

DETAILED DESCRIPTION OF THE DISCLOSURE

Examples of an electronic game device are shown in the drawings. Unless otherwise specified, an electronic game device may, but is not required to contain at least one of the structure, components, functionality, and/or variations described, illustrated, and/or incorporated herein.

An exemplary game device, indicated generally at 10 and shown in FIGS. 1-5 and 7, may include a plurality of sensor sections 12, 14, 16 and/or 18, also referred to as units, which may be moveable with respect to one or more of the other sensor sections. Game device 10 may be an electronic game device and/or a light-sensing game device. For example, game device 10 may include four sensor sections 12, 14, 16 and 18. Sensor sections 12, 14, 16, and 18 may also be described as a first outer sensor section 12 and a second outer sensor section 18, and one or more inner or central sensor sections 14,16. Each sensor section 12, 14, 16 and 18 may include a frame member 20 defining a sensor space 22, or a light beam interception zone. Each frame member 20 may define an arciform or semi-oval sensor space 22.

A game orientation and form of sensor sections 12, 14, 16 and/or 18 of other embodiments may vary, and such variations are considered to be within the scope of this disclosure. For example, sensor sections 12, 14, 16 and/or 18 and/or frame members 20 may define sensor space 22, which may have any suitable size and shape; and sensor sections 12, 14, 16 and/or 18 may include any number of frame members 20, arranged in any suitable manner relative to the other sensor sections 12, 14, 16 and/or 18 and/or frame members 20.

One or more proximity sensors 24 and one or more output devices 35 (FIG. 8) may be operatively connected to sensor sections 12, 14, 16, and/or 18. Each frame member 20 may include one or more proximity sensors 24 actuable upon placement or detection of an object within sensor space 22 of the associated sensor section 12, 14, 16, and/or 18, such as a player's hand being placed through frame member 20. One or more proximity sensors 24 may be light sensors and may include an infrared (IR) light emitting device 26*a*, for example an IR light-emitting diode (LED), such that an IR beam runs across frame member 20 and sensor space 22, and an IR light detecting device 26*b*, such as an IR photodiode. Sensor space 22 may be a light interception zone. Additionally and/or alternatively, any suitable proximity sensing device may be used, including a magnetic structure and/or a mechanical structure.

Further, in other embodiments, each frame member 20 may include more than one proximity sensor 24, and/or proximity sensor 24 adapted to determine from which of two opposing directions the object is placed into sensor space 22. Such embodiments may thus be able to differentiate, for example, between two players situated on opposite sides of frame member 20, each of whom may place the object (such as the player's hand) into sensor space 22.

One or more of sensor sections 12, 14, 16, 18 may be moveably connected and/or hingedly connected to one or more of the other sensor sections 12, 14, 16 and/or 18. For example, game device 10 may include one or more hinges 28, or hinged connections, disposed between two sensor sections. For example, the embodiment shown in FIGS. 1-5 and 7 includes three hinges 28 disposed between sensor sections 12 and 14, 14 and 16, and 16 and 18, respectively. Hinge 28 may include a mechanical hinge, made up of multiple parts that are each stationary but together create the ability to bend (similar to a hinge on a door). A typical example of a mechanical hinge is the hinge used on a door. Additionally and/or alternatively, hinge 28 may include a living hinge or thinned section of plastic or other material that bends to allow movement of the connected sensor sections 12, 14, 16 and/or 18.

Other embodiments may include one or more sensor sections 12, 14, 16 and/or 18 that are separable with respect to one another. For example, one or more of the sensor sections 12, 14, 16 and/or 18 may include a magnet assembly wherein the sensor sections 12, 14, 16 and/or 18 are magnetically and removably attached to one another, as described in further detail below.

Figure 8:
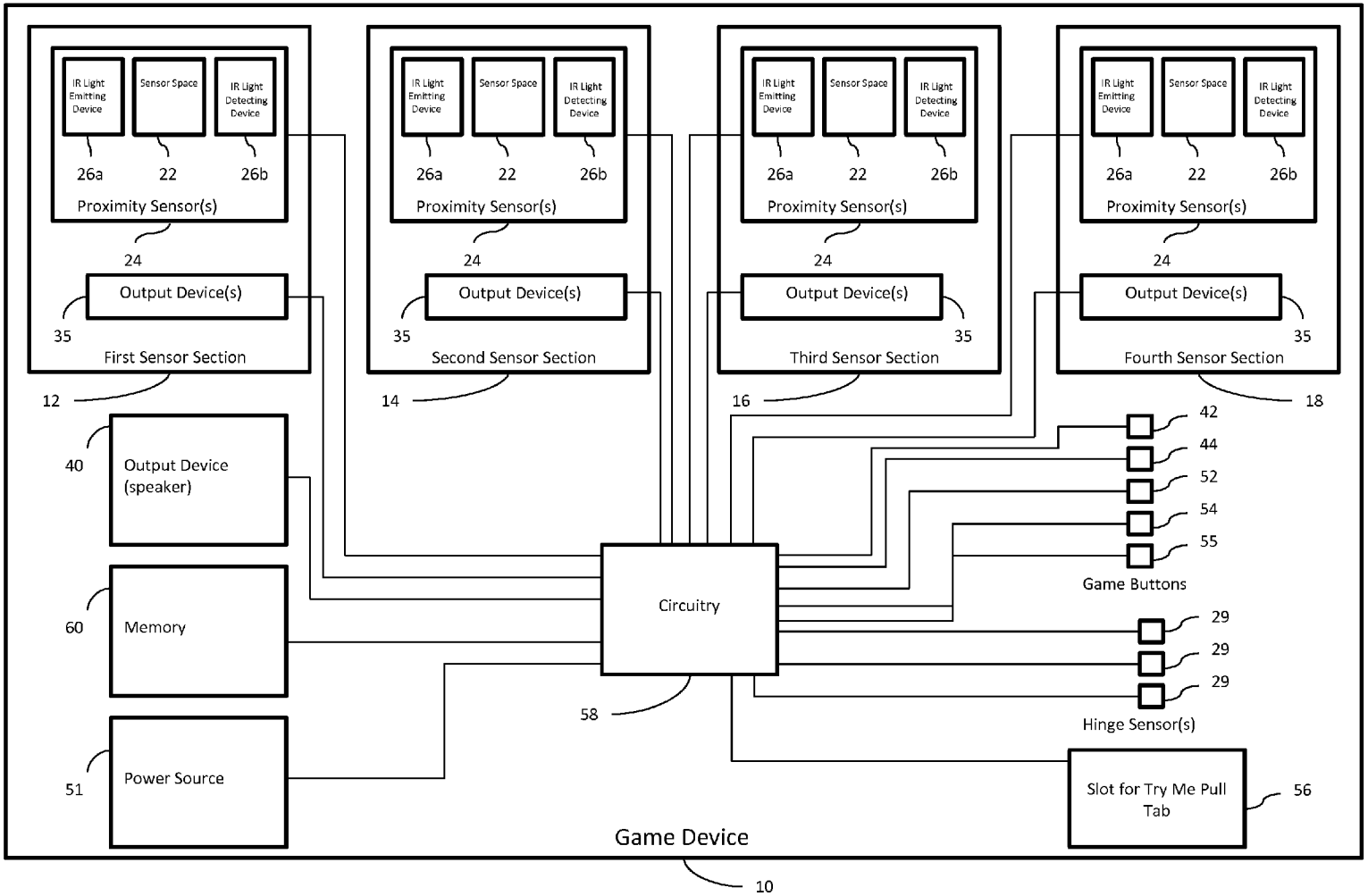
FIG. 8 is a block diagram of the game device of FIG. 1 showing connections to circuitry.

Hinge 28 may be bendable in one or more directions. One or more of hinges 28 may include one or more hinge sensors 29 (FIG. 8). One or more hinge sensors 29 may include a flexible wire (not shown) and may detect movement and/or position of one or both of sensor sections 12 and 14, 14 and 16, and/or 16 and 18, joined at the hinge 28. The collected detected movement and/or position of sensor sections 12, 14, 16, and/or 18, also referred to as the game orientation of the sensor section 12, 14, 16 and/or 18, may determine mode(s) of game play and/or may determine the difficulty level of game play.

Figure 6:
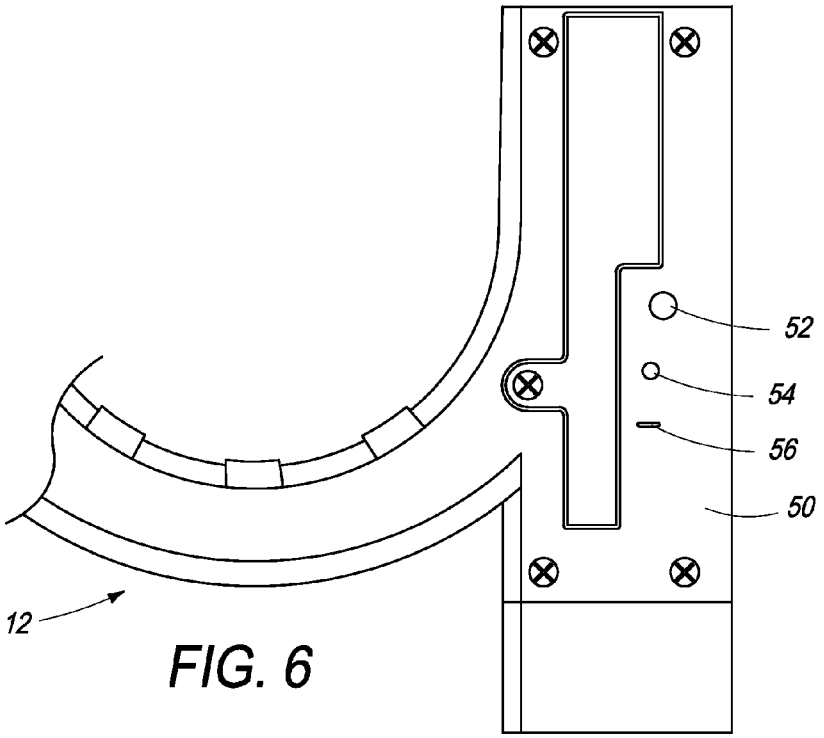
FIG. 6 is a plan view of a portion of an embodiment of the game device including a housing and a button configured to detect the game orientation of the game device in accordance with the present disclosure.
Figure 7:
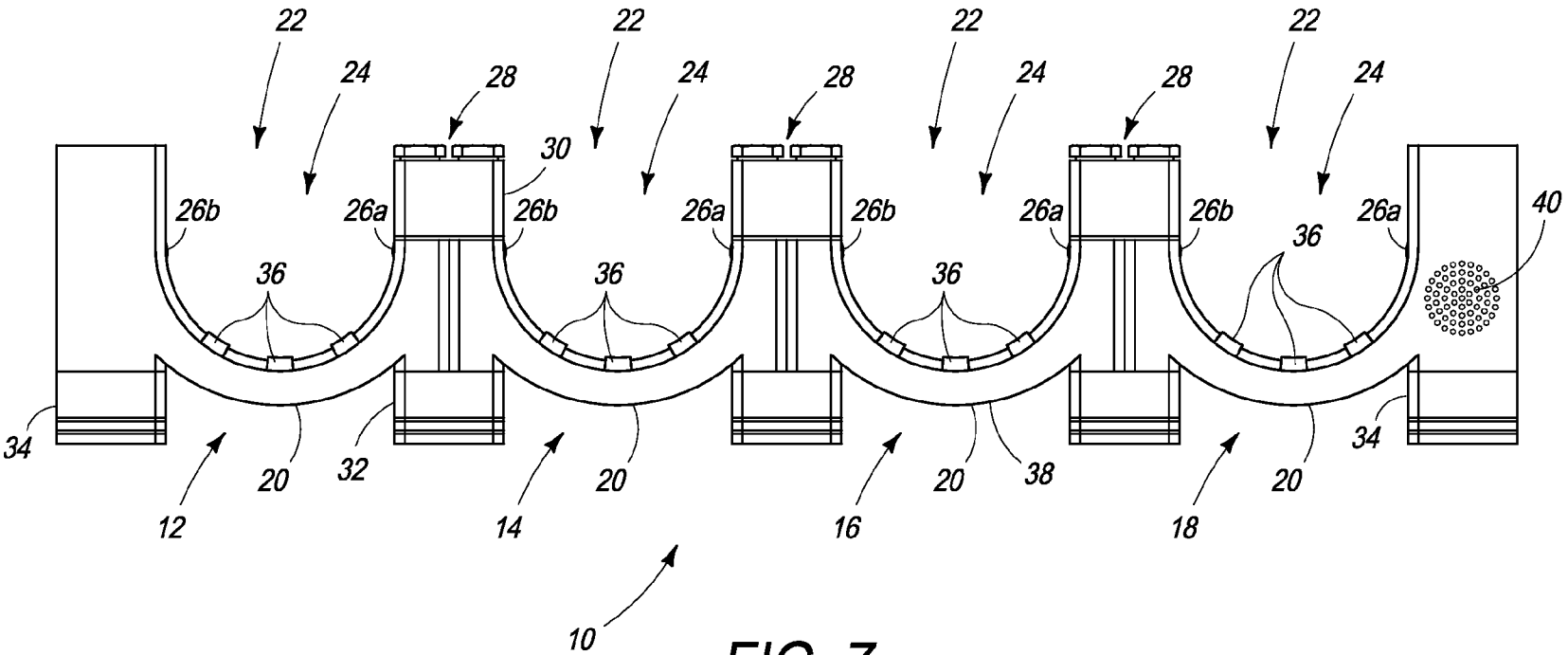
FIG. 7 is a plan view of the game device of FIG. 1.

Additionally and/or alternatively, game device 10 may include other means to detect movement and/or position of one or more of sensor sections 12, 14, 16, 18, and/or the game orientation of sensor sections 12, 14, 16 and/or 18. For example, one or more of sensor sections 12, 14, 16, 18, shown as sensor section 12 in FIG. 6, may include a housing 50. Housing 50 may house a power source 51 (FIG. 8), such as one or more batteries. Housing 50 may include a button 52 configured to close a connection in response to a change in the game orientation of one or more of the other sensor sections 12, 14, 16, 18. For example, button 52 may be configured to close a connection when sensor section 18 is folded back over, such that activation of button 52 may indicate that game device 10 is in a bi-linear game orientation, a doubled-back/side-by-side game orientation, and/or a stacked game orientation.

Housing 50 may further include a reset button 54 configured to reset game play of game device 10. Housing 50 may further include a slot 56 for a "try-me" pull tab, as is known in the art. The pull tab, not shown, typically breaks electrical contact in a particular electric circuit. The pull tab is attached to the packaging, so that removal of housing 50 from the packaging also removes the pull tab from slot 56, thereby allowing the particular electric circuit to activate normal game play.

Figure 2:
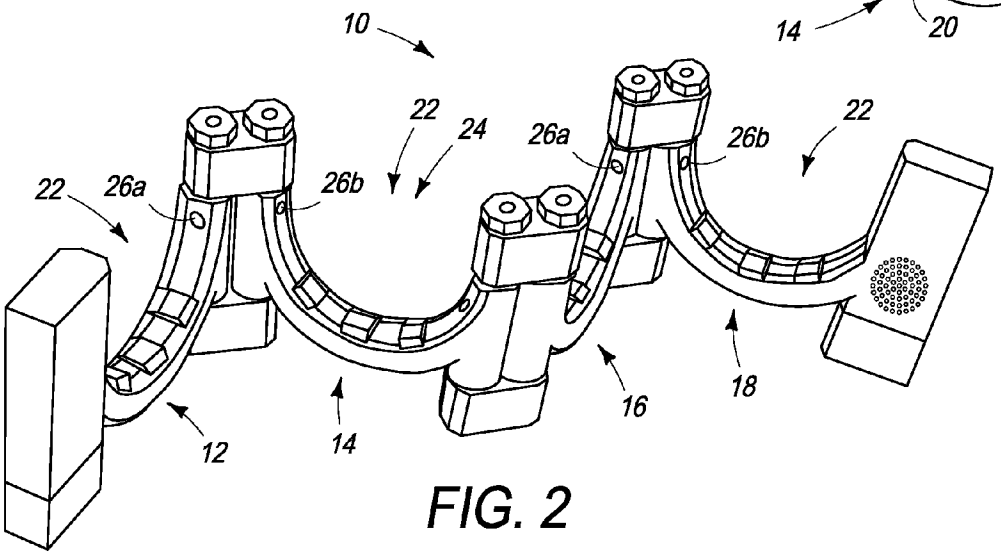
FIG. 2 is an upper perspective view of the game device of FIG. 1 in a multi-dimensional game orientation.
Figure 3:
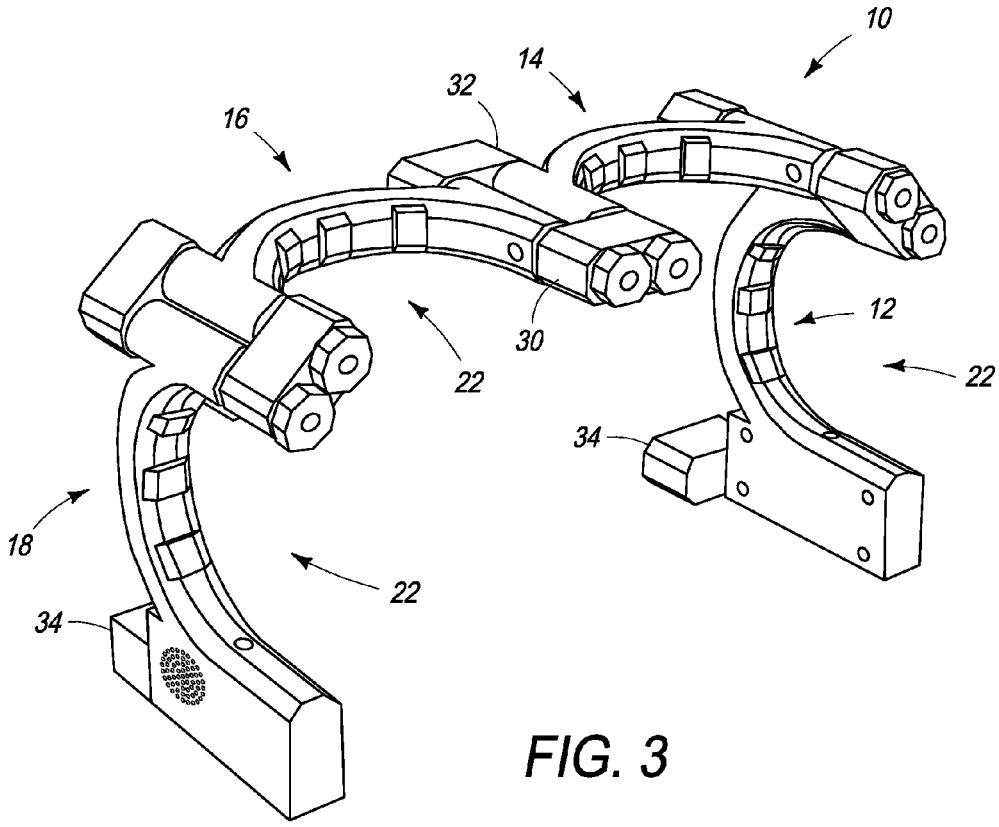
FIG. 3 is an upper perspective view of the game device of FIG. 1 in another multi-dimensional game orientation.

Turning now to FIGS. 1-5 and 7, hinge 28 may include one or more joining members. For example, an upper joining member 30 and a lower joining member 32 may join together neighboring sensor sections 12 and 14, 14 and 16 and 16 and 18. The outermost sensor sections 12, 18 may further include a base member 34. Base member 34 may be rotatable to provide further balance in the game orientation, as shown in FIG. 3.

Sensor sections 12, 14, 16, and/or 18 may also include one or more output devices 35 (FIG. 8), such as a plurality of illumination devices. For example, the plurality of illumination devices may include LEDs 36, which may be disposed on each sensor section 12, 14, 16 and/or 18 (FIGS. 1-5 and 7). LEDs 36 may be disposed at a lower arc portion 38 of frame member 20. LEDs 36 may be configured to be prompted to turn on or flash to indicate during game play that one or more proximity sensors 24 should be actuated. Alternatively, LEDs 36 may be configured to be prompted to flash upon actuation of one or more proximity sensors 24. LEDs 36 may be colored, for example blue and red, and the color may alternate depending on sensor section 12, 14, 16, and 18.

One or more of sensor sections 12, 14, 16, 18, for example one of outer sensor sections 12 or 18, may include a further output device such as a speaker 40 and/or buttons 42, 44. Speaker 40 may be configured to emit sound signals, such as during game play. Buttons 42, 44 on sensor section 12, 14, 16, and/or 18 may be configured to power game device 10 on or off and/or start a new game.

As shown in FIGS. 1-5, the hinged connection(s), provided by hinges 28, between sensor sections 12, 14, 16 and/or 18 may allow game device 10 to be used in various game orientations.

As shown in FIG. 1, game device 10 may be used in a linear game orientation, which may include at least two sensor spaces 22 in an approximate line.

Figure 5:
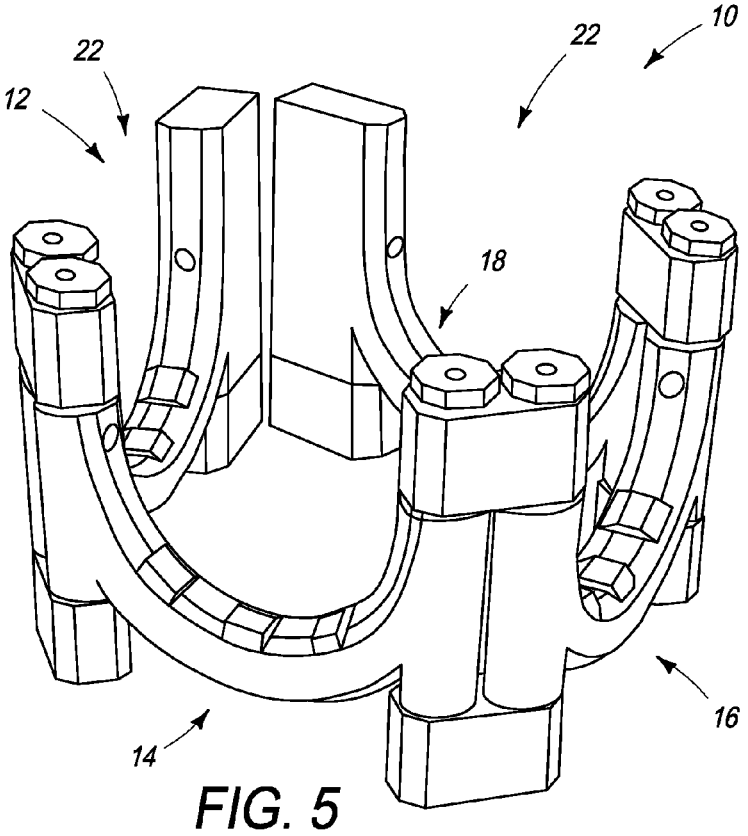
FIG. 5 is an upper perspective view of the game device of FIG. 1 in a quadrilateral game orientation.

As shown in FIGS. 2, 3 and 5, game device 10 may be used in one or more multi-dimensional game orientations, which may include sensor space 22 of sensor section 12 oriented along a line transverse to the orientation of sensor space 22 of sensor section 14.

FIG. 2 shows game device 10 in a wave game orientation, in which sensor spaces 22 of sensor sections 12, 14, 16, and 18 may be in alternate acute and obtuse angles with respect to an approximate plane.

FIG. 3 shows game device 10 in an arc game orientation, in which inner sensor sections 14, 16 align along the approximate plane and outer sensor sections 12, 18 extend transverse to the approximate plane.

Figure 4:
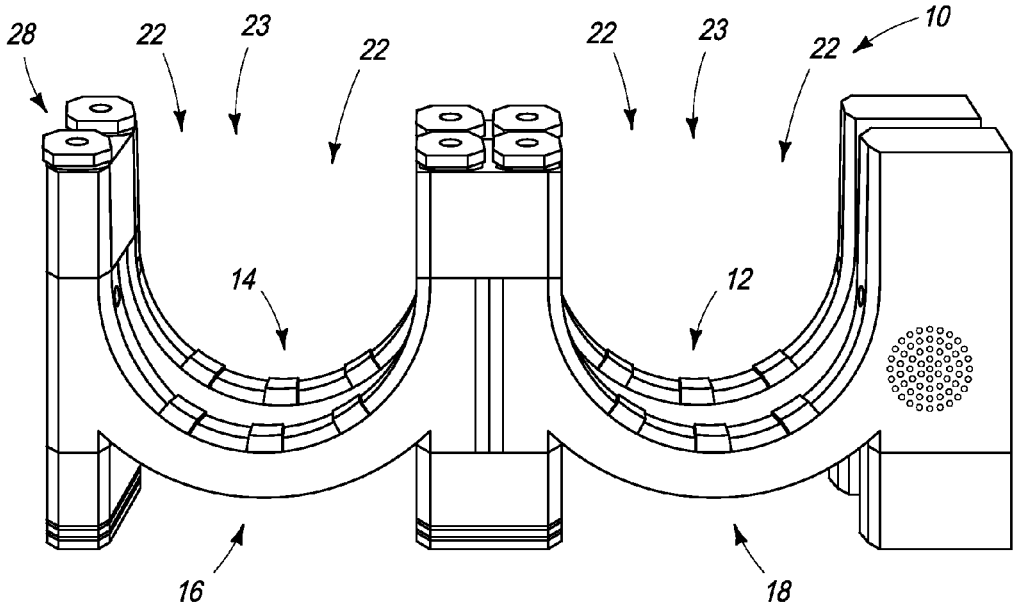
FIG. 4 is an upper perspective view of the game device of FIG. 1 in a bi-linear game orientation.

As shown in FIG. 4, game device 10 may be used in the bi-linear, or stacked, game orientation, which may include sensor space 22 of first sensor section 12 and the sensor space 22 of second sensor section 14 on opposing sides of the approximate plane, which may form at least one matched sensor space 23. FIG. 4 shows two matched sensor spaces 23. One or more hinge sensors 29 (FIG. 8) may be configured to circuitry 58 to determine the game orientation, wherein circuitry 58 may also be configured to determine the direction the object is placed in at least one matched sensor space 23 if game device 10 is being played in the bi-linear game orientation. Furthermore, circuitry 58 may be configured to provide output signal instructions to convert sensor sections 12, 14, 16, and/or 18 to a second game orientation after a lower level of difficulty is completed in a first game orientation, and to determine whether the proximity sensors 24 are actuated according to a predetermined pattern.

As shown in FIG. 5, game device 10 may be used in a quadrilateral game orientation, in which hinges 28 between first sensor section 12 and the second sensor section 14, between second sensor section 14 and third sensor section 16, and between third sensor section 16 and fourth sensor section 18 may allow sensor spaces 22 to be oriented to form an approximate quadrilateral.

Turning now to FIG. 8, one or more of sensor sections 12, 14, 16, 18 may house circuitry 58 or other electronics, which may be connected to one or more proximity sensors 24 and one or more output devices 35, and may be suitable and/or configured to perform such functions as record the order in which various proximity sensors 24 are actuated, determine whether proximity sensors 24 are actuated according to the predetermined or recorded pattern, prompt output devices 35, such as LEDs 36 and/or speaker 40, to emit output signals and/or measure a duration of time. Circuitry 58 may further include functions such as determining the game orientation of sensor sections 12, 14, 16, and/or 18. As shown, game device 10 may also include memory 60 connected to circuitry 58.

A variety of play patterns may be adapted for use with game device 10, some of which may be preprogrammed into circuitry 58, such that a desired game or play pattern may be selected via the buttons on game device 10, activation of one or more of proximity sensors 24 and/or the game orientation of sensor sections 12, 14, 16, and/or 18. Gameplay may further include output signals emitted by game device 10. Output signals may include audio and/or visual signals. Output signals may be emitted as a prompt for user response or as an indicator of user action.

For example, upon powering game device 10, a user may select a play pattern. In an exemplary play pattern, also referred to as a "Repeat the Beat" game mode, game device 10 may emit output signals in the pattern that the player or players may attempt to repeat in the same order, such as by actuating sensors 24 in the order indicated by a series of flashing LEDs 36 on various frame members 20. In this example, game device 10 may be configured to indicate patterns of ascending or random length and/or difficulty. Such patterns may be preprogrammed or generated by circuitry 58 according to preprogrammed pattern generation instructions. This exemplary play pattern may be similar to that or derived from the SIMON electronic memory game by MILTON BRADLEY.

As another example of a play pattern, also referred to as "Reflex Master" game mode, game device 10 may emit an output signal, such as illuminating a set of LEDs 36 in one of frame members 20, and the user responds by actuating proximity sensor 24 in that frame member 20 as quickly as possible. Game device 10 may then randomly illuminate another or the same set of LEDs 36 to prompt user activation of the same or another proximity sensor 24. This exemplary play pattern may be similar to that or derived from the WHAC-A-MOLE arcade game.

A further example may include a play pattern in which the player actuates one or more of proximity sensors 24 by passing his or her hands through the various frame members 20 in a desired order. Circuitry 58, which may be within game device 10, may record this order, and then the player, or one or more other players, may attempt to emulate the first player's pattern, with game device 10 configured to emit output indicative of an incorrect (or correct) order of actuation of proximity sensors 24.

As another example, two or more players may cooperate to form a pattern of proximity sensor 24 actuation and then attempt to repeat the completed pattern. Such patterns in this example may include player-specific aspects, such as if game device 10 is configured to differentiate between two players on opposite sides of the support structure.

In any of these examples, game device 10 may be configured to measure durations of time to allow players to attempt to complete the indicated pattern within the predetermined duration of time. Output signals may be emitted, as sound or light signals, to indicate that the player has succeeded or failed in completing the predetermined pattern correctly within the allotted time.

Additionally and/or alternatively, each play pattern or game mode may include varying levels of difficulty. The player may advance to the next level of difficulty after successfully completing the first level of difficulty. An "increased" level of difficulty may have a decreased amount of response time compared to other levels. Alternatively or additionally, an increased level of difficulty may include an additional level of complexity compared to other levels, such as requiring the use of two hands rather than one.

Some embodiments may further include a "shifter" game mode. In an exemplary embodiment of the shifter game mode, game device 10 instructs the player to change the game orientation before playing the next level. This instruction may occur between difficulty levels of the same game. For example, the player may complete the first level of the Reflex Master game in the wave game orientation. The device may then instruct the player to change game device 10 into the quadrilateral game orientation for the second level. The player reconfigures game device 10 into the quadrilateral game orientation before the player starts the second level. The player then starts and completes the second level while game device 10 is in the quadrilateral game orientation. The shifter game mode may be utilized in the Reflex Master game or in the Repeat the Beat game. Furthermore, the shifter game mode may be utilized between turns, when multiple players are competing against each other. In alternative embodiments of the shifter game mode, game device 10 instructs the player to change game orientations while in mid-level. The mid-level game orientation change may be an effective method of increasing the difficulty of a particular level or game.

Figure 9A:
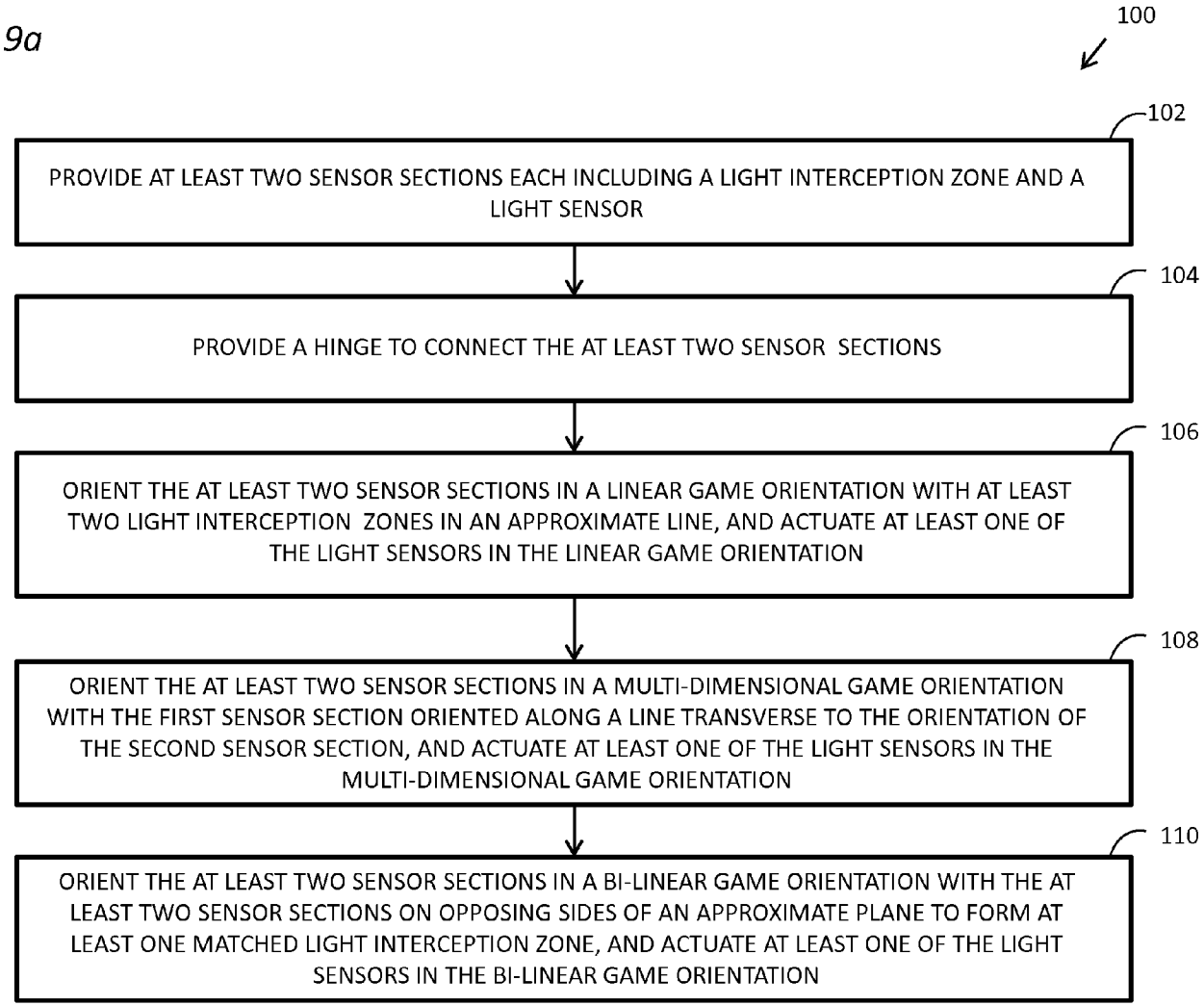
FIG. 9*a* is a flow chart of a method of playing an embodiment of a game device in accordance with the present disclosure.

Turning now to the flowchart shown in FIG. 9*a*, an exemplary method 100 of playing an electronic game may include providing at least two sensor sections each including a light interception zone and a light sensor 102; and providing a hinge to connect the at least two sensor sections 104. Method 100 of playing an electronic game may also include orienting the at least two sensor sections in a linear game orientation with at least two light interception zones in an approximate line and actuating at least one of the light sensors in the linear game orientation 106. Method 100 of playing an electronic game may also include orienting the at least two sensor sections in a multi-dimensional game orientation with the first sensor section oriented along a line transverse to the orientation of the second sensor section and actuating at least one of the light sensors in the multi-dimensional game orientation 108. Orienting the game in the multi-dimensional game orientation may include receiving instruction from the electronic game device to orient the game device in the multi-dimensional game orientation with the first sensor section oriented along the line transverse to the orientation of the first sensor section. Method 100 of playing an electronic game may also include orienting the at least two sensor sections in a bi-linear game orientation with the at least two sensor sections on opposing sides of an approximate plane to form at least one matched light interception zone and actuating at least one of the light sensors in the bi-linear game orientation 110. Orienting the game in the bi-linear game orientation may include receiving instruction from the electronic game device to orient the game device in the bi-linear game orientation with the at least two sensor sections on opposing sides of the approximate plane to form the at least one matched light interception zone.

Figure 9B:
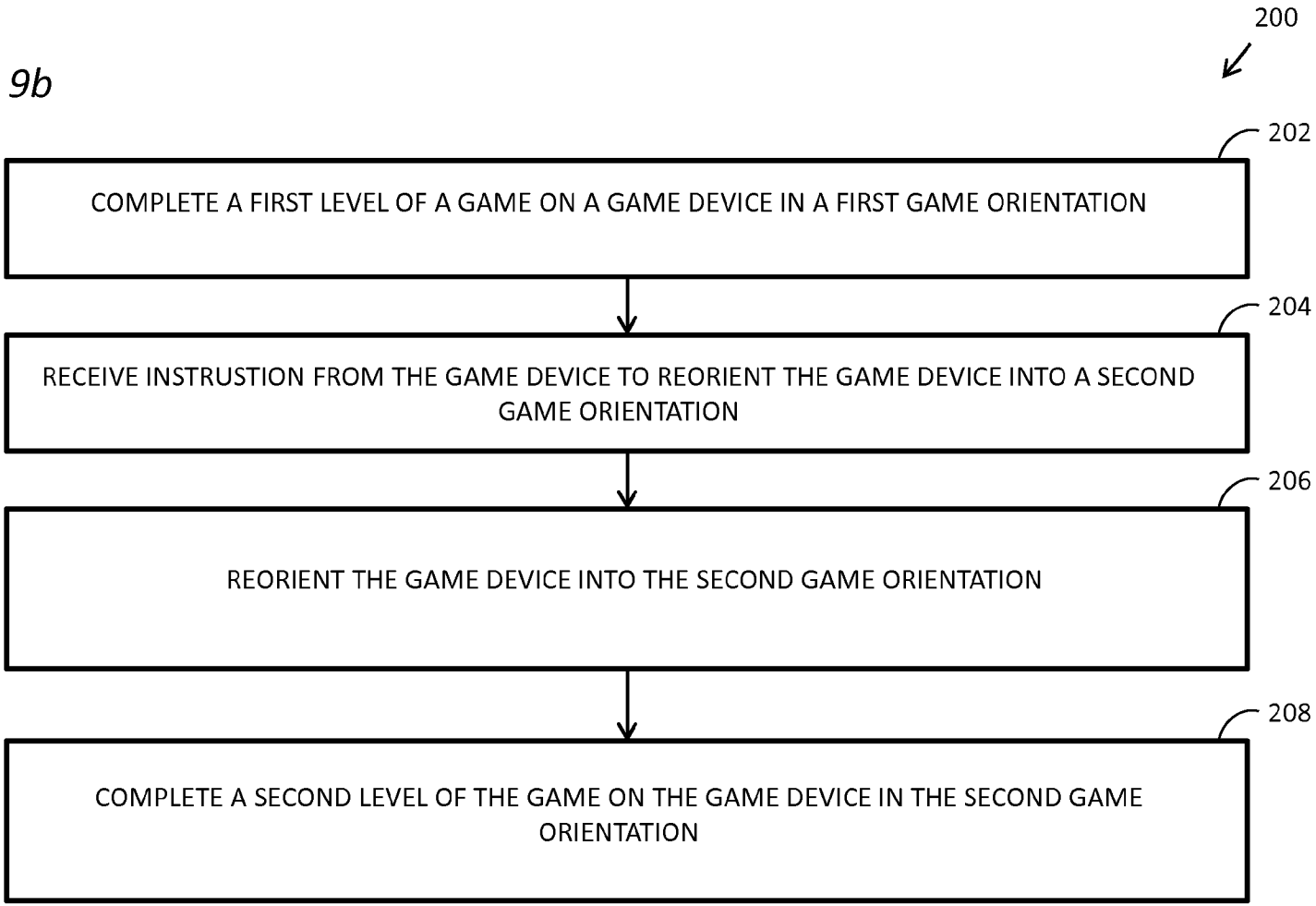
FIG. 9*b* is a flow chart of another method of playing an embodiment of a game device in accordance with the present disclosure.

Turning now to the flowchart shown in FIG. 9*b*, another exemplary method 200 of game play may include changing the orientation of game device 10 after completing a level and/or during mid-level of game play. For example, method 200 may include completing a first level of a game on game device 10 in a first game orientation 202, receiving instruction from game device 10 to reorient game device 10 into a second game orientation 204 and reorienting game device 10 into the second game orientation 206. Method 200 may further include completing a second level of the game on game device 10 in the second game orientation 208.

In some embodiments, the output signals, such as audio or sound volume, may function as an indicator of success and/or failure. For example, game device 10 may include a game volume produced by speaker 40 that functions as an indicator of failure in actuation of one or more proximity sensors 24 according to the predetermined pattern, such that the game volume decreases when the player incorrectly actuates one of proximity sensors 24. Play may begin with volume at 100%. When a player misses a play, the volume may decrease to 50% until the player can hit three plays in a row, at which the volume may resume at 100%.

Several aspects of the exemplary methods of game play may be modified from that disclosed above, and these methods and/or modifications may be reflected in a set of rules to accompany the game.

Optionally, as mentioned above, the game orientation of the game components may be modified to achieve a desired effect, in conjunction with the game rules. The apparatus and/or rules of the game may thus provide game play with a desired degree of complexity or difficulty, for example to adapt the game to players of a predetermined age range, and/or to adjust the relative degrees to which chance and strategy determine the winner of the game.

Alternatively, some embodiments of the present disclosure may be described as follows:

A new electronic toy combines music, motion, memory and modularity and includes new technology and new play patterns. The toy may include two or more semi-circular rings that may be reconfigurable and playable with new player motions and new game play. These rings may include an IR beam that projects through sensor space 22. The player's hand moves through sensor space 22 to break the beam. Each ring may include LEDs 36 that light up each ring as a visual prompt. The electronic toy may contain five different modes that use different light and sound prompts for different games. The toy may include a scoring mechanism, three difficulty levels, and vast array of entertainment for your eyes, ears and mind.

The Console

The console or game device 10 may come with four modular units or sensor sections 12, 14, 16, and 18 and may include four quadrants, also referred to as target regions or sensor spaces 22. The quadrants may be connected by a system of three hinges and may include or be embedded with LEDs 36. Two of the modular units may use red LEDs, while two other units may use blue LEDs.

The console also may include three main buttons on the end of the unit. A smaller button located on top of the console may function as a power button. Pressing the power button may power up the unit, while pressing and holding the power button may turn the unit off. A "Back to Main" button may be a larger button on the console. A player may exit out of any mode and return to the main menu at any time by pressing the Back to Main button. Pressing and holding the Back to Main button may activate the volume select mode.

Unit Configuration

Front=Power button and Back to Main button
*From Left to right
Q1 (First Quadrant)=Blue LEDs
Q2 (Second Quadrant)=Red LEDs
Q3 (Third Quadrant)=Blue LEDs
Q4 (Fourth Quadrant)=Red LEDs Menu Navigation Game device 10 may include a game menu, wherein navigation of the game menu may include breaking an infrared light beam produced by infrared light emitting device 26*a* in at least one of sensor sections 12, 14, 16, and/or 18. When in a "main menu" mode, the player may break the IR beam of different quadrants to navigate through different menus presented by game device 10. For example, breaking the IR beam in the second quadrant may indicate a selection "back" or "up" one from the current selection on a list of menu options, while breaking the IR beam in the third quadrant may indicate a selection "forward" or "down" one from the currently selected option. The selection may be accompanied by visual prompts of flashing LEDs 36. The player may break the IR beam in the first quadrant or the fourth quadrant to select a desired option, or simply wait for a set amount of time for game device 10 to make the selection without further prompting.

Difficulty

Each game may include three levels of difficulty. The first level may include only prompts for activation by a single hand. For example, only one unit at a time may light up. The first level of difficulty may also include the default level of speed for that game. The second level of difficulty may include mostly prompts for activation by a single hand with a low mix of prompts for activation using two hands. For example, the prompt for activation using two hands may include two quadrants lighting up at the same time, where both quadrants must be activated at the same time to achieve a "correct" response. The speed between prompts may also be faster than the speed at the first level. A third level of difficulty may include a heavy mix of prompts for activation using two hands, and the speed between prompts may be faster than the speed for the second level of difficulty.

Reconfigure Units

In some versions of a multiplayer mode, game device 10 may prompt the players to reorient the units between player turns. A first player may then challenge a second player with a different console game orientation.

Highest Rank and Winning

Scores in a single player mode may be ranked by number of correct hits. A matrix connecting the player's score to the ranking may vary between different games. For example, if the player hits 79 hits in 30 seconds and if it is the highest score, t game device 10 may say "Congratulations, you hit the new highest score. Great Job! You got 79 hits!" If the player hits 75 hits in 30 seconds and if it is not the highest score, game device 10 may say "Great job! You got 75 hits!" If the player does not perform well with only 15 hits in 30 seconds, the console may say "Try again next time. You got 15 hits!"

Game device 10 in a two player mode may only announce the winner and the winner's score at the end of the game.

Some embodiments of game device 10 may further be described as follows:

Game device 10 includes four rigid light-sensor units, each connected to an adjacent light-sensor unit by hinge 28. There may be three hinges 28, each including hinge sensor 29 that may determine whether the particular hinge 28 is straight or bent. The electronics, or circuitry 58, monitor each hinge sensor 29 to determine whether the four light-sensor units are set up in a straight line, a folded straight line, a table, or a square.

Example: As each ring lights up, you must put your hand through the lit frame member to keep up with the sequence. An internal voice counter keeps track of your best time and completed levels and tells you how well or how badly you did.

Game device 10 may further be described as a skill and action game where you must match the patterns of light and sound. Some embodiments may include a socket configured to be connected with an MP3 player. The MP3 player may bypass the embedded sound of game device 10.

Additionally and/or alternatively, some embodiments of game device 10 may include the following game play:

Gameplay

SIMON: Game device 10 may have four target areas or ring holes (or sensor spaces 22), which may be defined by frame members 20 and LEDs 36, which may be colored either blue or red. The unit may light these ring holes in a sequence, playing a tone for each ring hole; the player may move his or her hand through the holes in the same sequence. The sequence may begin with a single hole chosen randomly, and may add another randomly-chosen hole to the end of the sequence each time the player follows it successfully. Gameplay may end when the player makes a mistake or when the player wins (by matching the pattern for a predetermined number of tones). Basic rate of sound may be 12 kHz looping at 4 sec interval.

SPEED ZONE: This gameplay may include the same gameplay as SIMON except that the looping sound may be quicker (for instance, a 2 second interval) and the actual motion of the player response may follow suit. This game may involve strong focus and memory. Gameplay may end when the player makes a mistake or when the player wins (by matching the pattern for a predetermined number of tones).

KUNG FU: This may be a martial arts SIMON-esque game where you may master the sequencing of lights with kung-fu sound effects. The player may follow punch, block, and/or kick sound effects to please a Zen Master and become an ultimate Kung Fu Hero.

KUNG FU VS: This may be a two-player version of Kung Fu, wherein you may go head to head against a friend. You may match your adversary with the lights and sound effects of Kung Fu action. One player may start an attack as the other player may match the sequence of player one and may add one attack to the final round match. First player to lose sequencing track of the virtual fight may lose.

MUSIC MAKER: You may interact with game device 10 by making your own beats or rock out by mixing some guitar riffs. Looped sounds may be preset and it may be up to you to make a cool mix. Sounds may include scratches, drums, metal guitar, snare, and/or electronic bleeps and bloops.

Game device 10 may further be described as follows:

A light-beam sensing electronic game where the game is made in two separable/joinable modules, each with two light beams and two corresponding light beam sensors, the modules each have a communication system including both a wireless transmitter and receiver, and two separate wired connectors, magnets inside each module may hold the two modules together in different orientations, the wired connectors provide orientation input to microprocessors, and various pattern matching and guessing games may be played using the light beam sensors as input switches. Various pattern matching and guessing games may be played, using the four light beam sensors as input switches. Outputs include separate lights of various colors, and audio prompts and responses.

Game device 10 may include two modules, each with a battery, microprocessor, two light beams, two corresponding light beam sensors, audio and visual outputs, and communication system. Each communication system includes both a wireless infrared transmitter and receiver, and two separate wired connectors. Magnets inside each module may hold the two modules together in two different orientations—side-by-side or end-to-end. Corresponding electrical surface contact between corresponding wired connectors allows wired communication between the modules. The wired connectors provide orientation input to the microprocessors, because an active set of connectors indicates whether the modules are side-by-side or end-to-end. Each microprocessor monitors the wired connectors and wireless receiver to determine the current relative orientation or separation of the modules, as well as game play events.

Additionally and/or alternatively, some embodiments may include a higher-level concept of a SIMON-esque game with a modular arrangement of inputs, as well as any two-way communication methods used between those modular input arrangements. Some embodiments may include a pair of dual-U modules or with four individual-U modules. Preferably, the dual-U modules work like Master and Slave, with each unit capable of two-way communication via magnetic contacts and two-way IR communication.

Some embodiments of the present disclosure may include one or more of the following parts:

HOUSING A FRONT
HOUSING A REAR
HOUSING B FRONT
HOUSING B REAR
HOUSING C FRONT
HOUSING C REAR
HOUSING D FRONT
HOUSING D REAR
UNIT A BATTERY DOOR
BATTERY BOX
SPEAKER RETAINER
NUT COVER
SWITCH COVER
IR RECEIVER RETAINER
IR RETAINER
IR RECEIVER COVER
LIGHT PIPE
BATTERY DIVIDER
IR COVER
SCREW CAP
SPEAKER FRONT COVER
SWITCH COVER
KEY LOCK
HINGE LEFT
HINGE RIGHT
HINGE UPPER FRONT COVER
MOVABLE STAND FRONT
MOVABLE STAND REAR
LIGHT PIPE WHITE BOTTOM
HINGE LOWER FRONT COVER
HINGE LOWER REAR COVER
MOVABLE STAND HINGE
TOP HINGE COVER
STOPPER
STOPPER COVER
STOPPER LOCKER
SWITCH LOCKER MALE
SWITCH LOCKER FEMALE
4 LIGHT PIPES WITH SPRAYING AT LIGHT PIPES
SOUND AND LIGHT FOR MASTER UNION a. 85 sec©12K chip
b. 50 mm speaker
c. One Menu button;
d. One Power button;
e. Try-me pull selection switch;
f. Reset switch;
g. 4 pairs IR detect sensor
h. 3 AA battery

ELECTRONIC SUB ASSEMBLY a. PCB (1.50×3.50 in2, FR4 DS 1.03 mm Au)
b. PCB (0.80×1.80 in2, XPC SS 1.63 mm Au)
c. CAPACITOR; AL EL; 21; Tol. %: 20; F: 47; uF; V: 25
d. CAPACITOR; AL EL; 21; Tol. %: 20; F: 220; uF; V: 10
e. CAPACITOR; AL EL; 21; Tol. %: 20; F: 10; uF; V: 50
f. CAPACITOR; CHIP, Y5V; 56; Tol. %: +80%-20%; F: 0.1; uF; V: 50
g. RESISTOR (0.1 W, 5%, 1 Ohm to 10 M Ohm) SMT 0603
h. RESISTOR (0.1 W, 1%, 1 Ohm to 10 M Ohm) SMT 0603
i. TRANSISTOR (9014) 0.1 A 45V SOT 023
j. TRANSISTOR (8550) 0.5 A 40V SOT-23
k. TRANSISTOR (9015) 0.1 A 50V SOT 23
l. IR EMITTING DIODE, ROHS: Yes, P/N: IE-0505HP LXBXW: 3 mm
m. IR PHOTO-TRANSISTOR~ROHS: P/N: WPTS-332-TM
n. LED, Yellow, Mushroom head, Ultra Bright, 5 mm, 120 degree, Wartrony W05141YUC-A9I
o. LED, Red, Mushroom head, Ultra Bright, 5 mm, SB, M5R3UCA27, or Wartrony W05141RUC-W
p. TACT SWITCH; TS11A1TN16
q. USER INPUT; ROHS: Yes; P/N: LM339M; MOQ: L/T: Tol. %: DESC: OP AMP;
r. PUSH SWITCH; ROHS: P/N: PS12C3TN08;
s. SWITCH, push switch, PTS-11-ON-W
t. 3" 2 pin twist wires, AWG#28,
u. 5" 2 pin twist wires, AWG#28,
v. 7" 2 pin twist wires, AWG#28,
w. 16 pins FFC cable, 22 inch, 0.5 mm pitch,
x. 16 pins FFC connector, 0.5 mm pitch, horizontal mounting type
y. 12 pins FFC cable, 20 inch, 0.5 mm pitch
z. 12 pins FFC connector, 0.5 mm pitch, horizontal mounting type
aa. 8 pins FFC cable, 20 inch, 0.5 mm pitch
bb. 8 pins FFC connector, 0.5 mm pitch, horizontal mounting type
cc. BATT. CONTACT (3-AA BATTERIES) Steel dd. SOLDER/FLUX/GLUE ee. BATTERY (AA, GP15G)

ff. PTC, P/N: MF-R010-0-99 gg. SPEAKER (Æ 50 mm)

While embodiments of game device 10 have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. An electronic game device comprising:

a first sensor section hingedly connected to a second sensor section by a hinged connection;

one or more proximity sensors and one or more output devices operatively connected to the sensor sections; and circuitry connected to the one or more proximity sensors and the one or more output devices;

wherein the first sensor section and the second sensor section each includes a sensor space such that placement of an object in the sensor space of the associated sensor section actuates the one or more proximity sensors of that sensor section;

wherein the hinged connection allows the electronic game device to be used:

in a linear game orientation with at least two sensor spaces in an approximate line, in a multi-dimensional game orientation with the sensor space of the first sensor section oriented along a line transverse to the orientation of the sensor space of the second sensor section, and in a bi-linear game orientation with the first sensor section and the second sensor section on opposing sides of an approximate plane to form at least one matched sensor space; and wherein the circuitry is configured to determine whether the proximity sensors are actuated and to emit an output signal.

2. The electronic game device of claim 1, further comprising:

a third sensor section hingedly connected to the second sensor section and a fourth sensor section hingedly connected to the third sensor section;

wherein the sensor sections are hingedly connected by hinged connections;

wherein the third sensor section and the fourth sensor section each includes a sensor space and one or more proximity sensors such that placement of an object in the sensor space of the associated sensor section actuates the one or more proximity sensors of that sensor section; and wherein the hinged connections between the first sensor section and the second sensor section, between the second sensor section and third sensor section, and between the third sensor section and fourth sensor section allow the electronic game device to be used in a quadrilateral game orientation with the sensor space of the first sensor section, the sensor space of the second sensor section, the sensor space of the third sensor section, and the sensor space of the fourth sensor section oriented to form an approximate quadrilateral.

3. The electronic game device of claim 1, further comprising one or more hinge sensors configured to the circuitry to determine the game orientation.

4. The electronic game device of claim 1, wherein the circuitry is configured to determine a direction the object is placed in the at least one matched sensor space if the game is being played in the bi-linear game orientation.

5. The electronic game device of claim 1, wherein the one or more output devices include one or more LEDs disposed on each sensor section.

6. The electronic game device of claim 1, wherein the circuitry is configured to provide output signal instructions to convert the sensor sections to a second game orientation after a lower level of difficulty is completed in a first game orientation.

7. The electronic game device of claim 1, wherein the electronic game device includes a rotatable base member to provide balance.

8. The electronic game device of claim 1, further comprising a game volume produced by a speaker that functions as an indicator of failure in actuation of the proximity sensors according to a predetermined pattern, such that the game volume changes when a player incorrectly actuates one of the proximity sensors.

9. The electronic game device of claim 1, wherein the one or more proximity sensors include an infrared light emitting device and an infrared light detecting device.

10. The electronic game device of claim 9, further comprising a game menu, wherein navigation of the game menu includes breaking an infrared light beam in at least one of the sensor sections.

11. A method of playing an electronic game, comprising the steps of:

providing at least two sensor sections each including a light interception zone and a light sensor;

providing a hinge to connect the at least two sensor sections;

orienting the at least two sensor sections in a linear game orientation with at least two light interception zones in an approximate line, and actuating at least one of the light sensors in the linear game orientation; and orienting the at least two sensor sections in a multi-dimensional game orientation with the first sensor section oriented along a line transverse to the orientation of the second sensor section, and actuating at least one of the light sensors in the multi-dimensional game orientation.

12. The method of playing an electronic game of claim 11, wherein orienting the game in the multi-dimensional game orientation includes receiving instruction from the electronic game device to orient the game device in the multi-dimensional game orientation with the first sensor section oriented along the line transverse to the orientation of the first sensor section.

13. The method of playing an electronic game of claim 11, further comprising orienting the at least two sensor sections in a bi-linear game orientation with the at least two sensor sections on opposing sides of an approximate plane to form at least one matched light interception zone, and actuating at least one of the light sensors in the bi-linear game orientation.

14. The method of playing an electronic game of claim 13, wherein orienting the game in the bi-linear game orientation includes receiving instruction from the electronic game device to orient the game device in the bi-linear game orientation with the at least two sensor sections on opposing sides of the approximate plane to form the at least one matched light interception zone.

15. A light-sensing game device comprising:

a first sensor section connected to a second sensor section by a hinge;

one or more light sensors and one or more output devices operatively connected to the sensor sections; and circuitry connected to the one or more light sensors and the one or more output devices;

wherein the first sensor section and second sensor section each includes a light interception zone such that placement of an object in the light interception zone of the associated sensor section actuates the one or more light sensors of that sensor section;

wherein the hinge connecting the first sensor section to the second sensor section allows the light-sensing game device to be used:

in a linear game orientation with the light interception zones of the first sensor section and the second sensor section in an approximate line, in a bi-linear game orientation with the first sensor section and the second sensor section on opposing sides of an approximate plane to form at least one matched light interception zone; and wherein the circuitry is configured to determine whether the light sensors are actuated and to emit an output signal.

16. The light-sensing game device of claim 15, wherein the hinge connecting the first sensor section to the second sensor section allows the light-sensing game device to be used in a multi-dimensional game orientation with the first sensor section oriented along a line transverse to the orientation of the second sensor section.

17. The light-sensing game device of claim 15, further comprising:

a third sensor section hingedly connected to the second sensor section, and a fourth sensor section hingedly connected to the third sensor section;

wherein the third sensor section and the fourth sensor section each includes a light interception zone and one or more light sensors such that placement of an object in the light interception zone of the associated sensor section actuates the one or more light sensors of that sensor section; and wherein the electronic game device may be used in a quadrilateral game orientation with the light interception zones of the first sensor section, the light interception zones of the second sensor section, the light interception zones of the third sensor section, and the light interception zones of the fourth sensor section oriented to form an approximate quadrilateral.

18. The light-sensing game device of claim 15, further comprising one or more hinge sensors to determine the game orientation.

19. The light-sensing game device of claim 15, wherein the one or more output devices includes one or more LEDs disposed on each sensor section.

20. The light-sensing game device of claim 15, wherein the circuitry is configured to provide output signal instructions to convert the sensor sections to a second game orientation after a lower level of difficulty is completed in a first game orientation.

21. The light-sensing game device of claim 15, wherein the light-sensing game device include a rotatable base member to provide balance.

22. The light-sensing game device of claim 15, further comprising a game volume produced by a speaker that functions as an indicator of failure in actuation of the light sensors according to a predetermined pattern, such that the game volume changes when a player incorrectly actuates one of the light sensors.

23. The light-sensing game device of claim 15, wherein the one or more light sensors include an infrared light emitting device and an infrared light detecting device.

24. The light-sensing game device of claim 23, further comprising a game menu, wherein navigation of the game menu includes breaking an infrared light beam in at least one of the sensor sections.

* * * * *